United States Patent [19]

Erhard

[11] 4,428,333

[45] Jan. 31, 1984

[54] ELECTRONIC IGNITION DEVICE FOR COMBUSTION ENGINES

[75] Inventor: Werner Erhard, Cadolzburg, Fed. Rep. of Germany

[73] Assignee: Helga Müller-Dutschke, Cadolzburg, Fed. Rep. of Germany

[21] Appl. No.: 394,197

[22] Filed: Jul. 1, 1982

[30] Foreign Application Priority Data

Dec. 31, 1981 [DE] Fed. Rep. of Germany ..... 3152015

[51] Int. Cl.[3] ..... F02P 1/00; F02P 1/08

[52] U.S. Cl. ..... 123/149 C; 123/149 R; 123/652; 123/599; 123/146.5 A

[58] Field of Search ..... 123/146.5 A, 594, 596, 123/599, 604, 605, 149 A, 149 R, 149 C, 652; 310/70 A; 315/218

[56] References Cited

U.S. PATENT DOCUMENTS

| | | | |
|---|---|---|---|
| 3,242,420 | 3/1966 | Ulrey | 123/596 |
| 3,251,351 | 5/1966 | Bauers | 123/605 |
| 3,933,139 | 1/1976 | Beeghly | 123/599 |
| 4,188,929 | 2/1980 | Podrapsky et al. | 123/146.5 A |
| 4,236,494 | 12/1980 | Fairchild | 123/599 |
| 4,269,152 | 5/1981 | Van Siclen, Jr. | 123/146.5 A |
| 4,329,950 | 5/1982 | Orova et al. | 123/599 |
| 4,378,769 | 4/1983 | Haubner et al. | 123/599 |
| 4,391,236 | 7/1983 | Anderson | 123/596 |

*Primary Examiner*—Raymond A. Nelli
*Attorney, Agent, or Firm*—Jordan and Hamburg

[57] ABSTRACT

The ignition coil of an electronic ignition system, wherein a voltage is induced in the coil by way of a magnet wheel, has an auxiliary coil connected to charge a capacitor by way of a diode. The different voltage of the auxiliary coil and capacitor controls the cut-off of current in the ignition coil.

7 Claims, 4 Drawing Figures

ELECTRONIC IGNITION DEVICE FOR COMBUSTION ENGINES

BACKGROUND OF THE INVENTION

This invention relates to an electronic ignition device for combustion engines having an ignition coil coupled to the combustion engine by way of a magnet wheel, wherein the primary circuit of the coil is interrupted at the desired ignition instant by a transistor switch, and wherein the switching transistor is then switched on by means of an electronic component between its base and collector, and is finally turned off at the ignition instant by a control element.

Many such electronic ignition devices have been known. As examples only, we refer to the German DOS No. 2,730,002 and DOS No. 2,686,428. All of these conventional known ignition devices have the common feature that when the primary coil is excited, the transistor switch is switched on by way of an electric component in the form of a resistance. The control transistor (which may, or course, alternatively be a control thyristor) shortcircuits the base and the emitter of the transistor switch at the ignition instant, so that it interrupts the energy flow in the primary coil, thereby producing the ignition voltage by induction in the secondary coil.

In all known switching systems, a voltage divider determines when the switch transistor is to be cut off by the control element. This has the disadvantage, however, that such a voltage divider must be aligned and that it is necessary to provide temperature compensation for the transistor switch as well as for the control element.

SUMMARY OF THE INVENTION

An object of the invention is to provide an electronic ignition device for combustion engines of the above type which in it is possible to provide accurate setting of the desired ignition instant without troublesome adjustment of the switching and the need to provide special means for temperature compensation. In accordance with the invention, an ignition device that satisfies this object is comprised of an auxiliary circuit of an auxiliary coil coupled magnetically to the ignition coil, a capacitor, and a diode, the control path of the control component being connected in parallel with the auxiliary circuit.

The auxiliary coil changes the capacitor by way of the diode as long as induction, and thereby voltage, increases in the auxiliary coil. After exceeding the maximum voltage, the voltage remains on the capacitor, while voltage of the auxiliary coil decreases. When the difference in voltage reaches the threshold voltage of the control component, such as a thyristor, the latter switches on and blocks conduction in the transistor switch. Due to such switching, the ignition instant, if necessary, occurs shortly after the largest possible energy intake by the primary coil. If, for example, assuming that voltage values between 20 and 30 volts are induced in the auxiliary coil and that the threshold voltage for a thyristor is about 0.7 volts, it is apparent that this threshold voltage has actually already occurred when most of the energy is still stored in the primary coil.

The switching according to the present invention may, however, still be further improved, if the auxiliary coil and the capacitor are dimensioned in such a way that the maximum voltage of the auxiliary coil is enhanced by parallel resonance. In this way, the ignition instant may be set accurately at the point of maximum energy intake by the primay coil, or even before such point.

Finally, it is also within the scope of the invention to provide the electronic component in the form of a drive transistor, wherein the control component bridges the base-emitter path of the drive transistor. This previously proposed modification of the known systems prevents damping of the primary coil through the base-resistance contemplated in the switching of the above references. Such base-resistance permitted the energy of the primary coil to only partially be used for the ignition spark.

Further advantages, features and details of the invention will be apparent from the following disclosure of several embodiments of the invention, as well as from the drawings herein.

DESCRIPTION OF THE PREFERRED EMBODIMENTS

Figure 1:
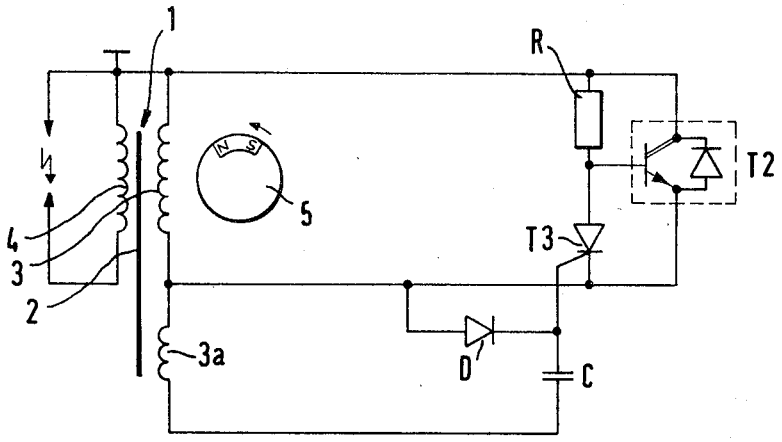
FIG. 1 is a circuit diagram of an electronic ignition device in accordance with the present invention, in which the electronic component is a resistance.
Figure 2:
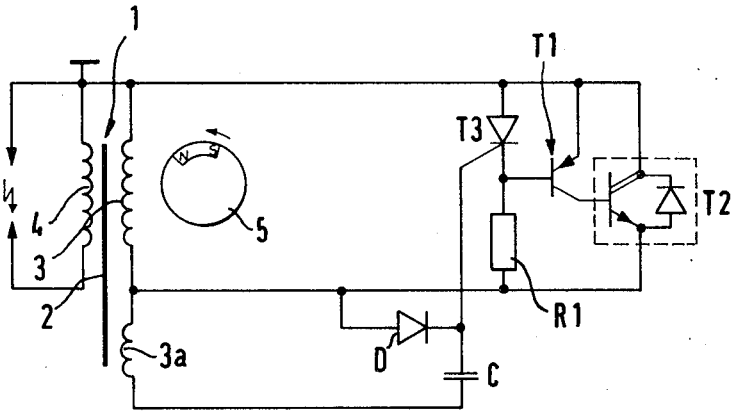
FIG. 2 is a circuit diagram of a modified switching system corresponding to FIG. 1, employing a drive transistor as an electronic component.

The two illustrated ignition devices, shown in FIGS. 1 and 2, are comprised of an ignition coil 1 with a magnetic core 2, as well as a primary winding 3 and a secondary winding 4. Voltage is induced across the primary coil 3 by means of the permanent magnet of a magnet wheel 5 adapted to be moved past the ignition coil. The magnet wheel 5 is connected to be rotated by the combustion engine. It may, for example, be a part of the fan. This voltage causes the switching transistor T2 to be switched on due to the current flow through the base emitter junction and resistor R, as shown in FIG. 1. Current now flows through the switching transistor T2.

Auxiliary coil *3a*, coupled magnetically to ignition coil 1, charges capacitor C by way of diode D as long as voltage induced in the auxiliary coil increases. After passing the maximum induced voltage, this voltage is stored across capacitor C, while the voltage across the auxiliary coil *3a* decreases. When the difference between the coil *3a* voltage and the capacitor voltage reaches the threshold voltage of the control thyristor T3, the latter switches on thereby stopping current flow in the switching transistor T2. The ignition instant, however, will always be very shortly after the largest possible energy storage by primary coil 3. This means optimal use of energy of the energy induced by the rotating permanent magent of the magnet wheel 5. In the switching described, high voltage is produced even with only a relatively small rotation speed. This feature is especially advantageous in the starting of a internal combustion engine by hand. A further advantage of this embodiment is the earlier resetting with increases in the rotation speed. After exceeding the maximal value, the voltage decrease in the auxiliary coil with higher rotation speeds occurs more sharply. This results in the earlier attainment of the voltage difference between capacitor voltage and the auxiliary coil voltage, so that the transistor switches on earlier. In addition, parallel resonance may also be used by a corresponding dimensioning of auxiliary coil 3*a* and of capacitor C, which increases the maximum voltage of the auxiliary coil. As a result, the ignition instant can be set on or even before the instant of maximum energy takeup by the primary coil, since the voltage rise occurs, as a practical matter, with continuously decreasing instantaneous frequencies, and the maximum voltage of the auxiliary coil is increased as a result of use of the parallel resonance of the capacitor and the auxiliary coil.

Figure 3:
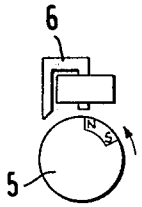
FIGS. 3 and 4 are simplified diagrams of two different embodiments of an ignition arrangement according to the present invention.

FIG. 2 shows an embodient of thi ignition device of the present invention with improved energy utilization. Resistance R in FIG. 1 dampens the primary coil. For this reason, in the embodiment according to FIG. 2, it is replaced by a drive transistor T1. At the switched-on time moment, the drive transistor represents a very low resistance for switching-on the switching transistor, while it is relatively high-ohmic at the ignition instant. Thereby the protective resistance R1 used in FIG. 3 may be ten times larger than resistance R in FIG. 1, so that no further dampening of the primary coil occurs.

Figure 4:
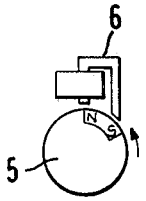

The ignition device of the present invention can be mounted on a two-legged core so that it requires very little space. To attain a large insurance against reverse operation, it is advantageous to employ the arrangement of FIG. 4, in which the ignition device is arranged on that leg of the two-legged core 6 that is mounted behind the other leg, with respect to the direction of rotation of rotating magnet 5.

What is claimed is:

1. In an electronic ignition device for combustion engines wherein an ignition coil is coupled to the combustion engine by a magnet wheel, the primary circuit of the coil is interrupted at the desired ignition instant by a circuit transistor switch, wherein the transistor switch is switched on by means connected between its base and collector and is blocked by a control component at the desired ignition instant, the improvement comprising an auxiliary circuit comprised of an auxiliary coil magnetically coupled to the ignition coil, a capacitor connected to be charged by the auxiliary coil by way of a diode, the control path of the control component being connected in parallel with the auxiliary circuit.

2. The electronic ignition device according to claim 1, wherein the control component is a thyristor.

3. The electronic ignition device according to claims 1 or 2, wherein the auxiliary coil and the capacitor are dimensioned such that the maximum voltage of the auxiliary coil is increased by parallel resonance.

4. The electronic ignition device according to claim 1, wherein the circuit means is a resistance and the control component is connected in the base-emitter circuit of the switching transistor.

5. The electronic ignition device according to claim 1, wherein the circuit means is a drive transistor, and the control component bridges the base-emitter path of the drive transistor.

6. The electronic ignition device according to claim 5, wherein the drive transistor is switched in parallel to the switch transistor in series with a protective resistance.

7. The electronic ignition device according to claims 1 or 2, wherein the coils are arranged on the leg of a two-legged core to lag in the direction of rotation of the magnet wheel.

* * * * *